US007523740B2

(12) United States Patent
Hoenig et al.

(10) Patent No.: US 7,523,740 B2
(45) Date of Patent: Apr. 28, 2009

(54) FUEL-INJECTION SYSTEM AND METHOD FOR INJECTING FUEL

(75) Inventors: Guenter Hoenig, Ditzingen (DE); Markus Gesk, Karlsbad (DE); Andreas Glenz, Kernen I.R. (DE); Ralf Bruenemann, Stuttgart (DE); Eberhard Holder, Esslingen (DE); Martin Matt, Bruchsal-Untergrombach (DE); Hans-Karl Weining, Esslingen (DE)

(73) Assignee: Robert Bosch GmbH, Stuttgart (DE)

( * ) Notice: Subject to any disclaimer, the term of this patent is extended or adjusted under 35 U.S.C. 154(b) by 129 days.

(21) Appl. No.: 10/566,862

(22) PCT Filed: Aug. 18, 2004

(86) PCT No.: PCT/EP2004/051818

§ 371 (c)(1),
(2), (4) Date: Sep. 19, 2006

(87) PCT Pub. No.: WO2005/019636

PCT Pub. Date: Mar. 3, 2005

(65) Prior Publication Data

US 2007/0169749 A1 Jul. 26, 2007

(30) Foreign Application Priority Data

Aug. 18, 2003 (DE) ..... 103 37 893

(51) Int. Cl.
*F02M 43/00* (2006.01)
*F02M 55/02* (2006.01)
*F02M 65/00* (2006.01)

(52) U.S. Cl. ..... 123/456; 123/470

(58) Field of Classification Search ..... 123/456, 123/575, 576, 577, 578, 179.17, 470, 299, 123/300, 27 GE; 239/600
See application file for complete search history.

(56) References Cited

U.S. PATENT DOCUMENTS

| | | | | |
|---|---|---|---|---|
| 4,499,862 | A * | 2/1985 | Baumer et al. | 123/1 A |
| 5,666,926 | A * | 9/1997 | Ferrera et al. | 123/525 |
| 5,887,799 | A * | 3/1999 | Smith | 239/585.1 |
| 6,142,107 | A * | 11/2000 | Stutzenberger | 123/27 GE |
| 6,604,510 | B2 * | 8/2003 | Scollard et al. | 123/470 |
| 6,962,142 | B2 * | 11/2005 | Sekine | 123/470 |
| 7,077,101 | B2 * | 7/2006 | Poola et al. | 123/299 |

(Continued)

FOREIGN PATENT DOCUMENTS

DE 849 325 9/1952

(Continued)

OTHER PUBLICATIONS

English Language Translation of Claim 1 of DE 849 325.

(Continued)

*Primary Examiner*—Stephen K Cronin
*Assistant Examiner*—Arnold Castro
(74) *Attorney, Agent, or Firm*—Kenyon & Kenyon LLP

(57) ABSTRACT

A fuel-injection system for injection of fuel into an internal combustion engine includes at least one fuel injector and a first fuel-distributor line which is connected to the at least one fuel injector. A second fuel-distributor line is provided which is connected to the at least one fuel injector via an individual corresponding lance.

10 Claims, 4 Drawing Sheets

U.S. PATENT DOCUMENTS

| | | | | |
|---|---|---|---|---|
| 2002/0038650 | A1 * | 4/2002 | Scollard et al. | 123/456 |
| 2004/0003795 | A1 * | 1/2004 | Kondo | 123/447 |

FOREIGN PATENT DOCUMENTS

| | | |
|---|---|---|
| DE | 969 853 | 7/1958 |
| DE | 101 23 867 | 11/2002 |
| EP | 1 258 628 | 11/2002 |
| GB | 405 833 | 2/1934 |
| GB | 1 150 043 | 4/1969 |

OTHER PUBLICATIONS

English Language Translation of Claim 1 of DE 969 853.

* cited by examiner

FUEL-INJECTION SYSTEM AND METHOD FOR INJECTING FUEL

FIELD OF THE INVENTION

The present invention relates to a fuel-injection system for injecting fuel into a combustion engine, and a corresponding method for injecting fuel.

BACKGROUND INFORMATION

A fuel injection system described in published German patent document DE 101 23 867 includes an auxiliary intake which is connected via a line to an interior chamber of the fuel injector. A purifying agent or a mixture from fuel and purifying agent(s) is able to be conveyed to the spray-discharge orifices of the fuel injector via the auxiliary intake. The purifying agent may be used to rinse the fuel injector and the spray-discharge orifices in order to reduce deposits.

Disadvantageous in the system described in the aforementioned German patent document is, in particular, that each fuel injector of an internal combustion engine must be provided with a corresponding intake, which furthermore must be positioned in a decentralized fashion from the fuel intake of the fuel injectors. The manufacturing expense is thus very high. Furthermore, a second intake, which interconnects the auxiliary intakes, must be installed, which entails further expense in components and installation time.

SUMMARY

The fuel-injection system according to the present invention and the corresponding method according to the present invention provide the advantage that various fuels for different operating states of the internal combustion engine are able to be conveyed in a simple manner via two fuel-distributor lines which are connected to the fuel injectors via a conventional connection and via a lance disposed therein.

It is advantageous, for example, that the second fuel-distributor line extends parallel to the first line and, for example, is soldered thereto.

Moreover, it is advantageous that standard fuel injectors are able to be used with the double fuel-distributor line without costly modifications.

In an advantageous manner, a non-return valve may be provided inside the lance, which is freely selectable for a variety of pressures and prevents a return flow of the startup fuel or the purifying liquid.

Furthermore, it is advantageous that the startup fuel is also able to be supplied via an outer sleeve on the outside of the fuel injector or via an additional supply line decoupled from the main supply line.

It is also advantageous that the lance penetrates the first fuel-distributor line, thereby avoiding an additional evaporation of the fuel flowing through the lance.

The composition of the startup fuel may advantageously be such that the cold-start characteristics of the internal combustion engine are able to be improved, the emissions reduced and the fuel injector is able to be kept free of deposits.

DETAILED DESCRIPTION

Figure 1:
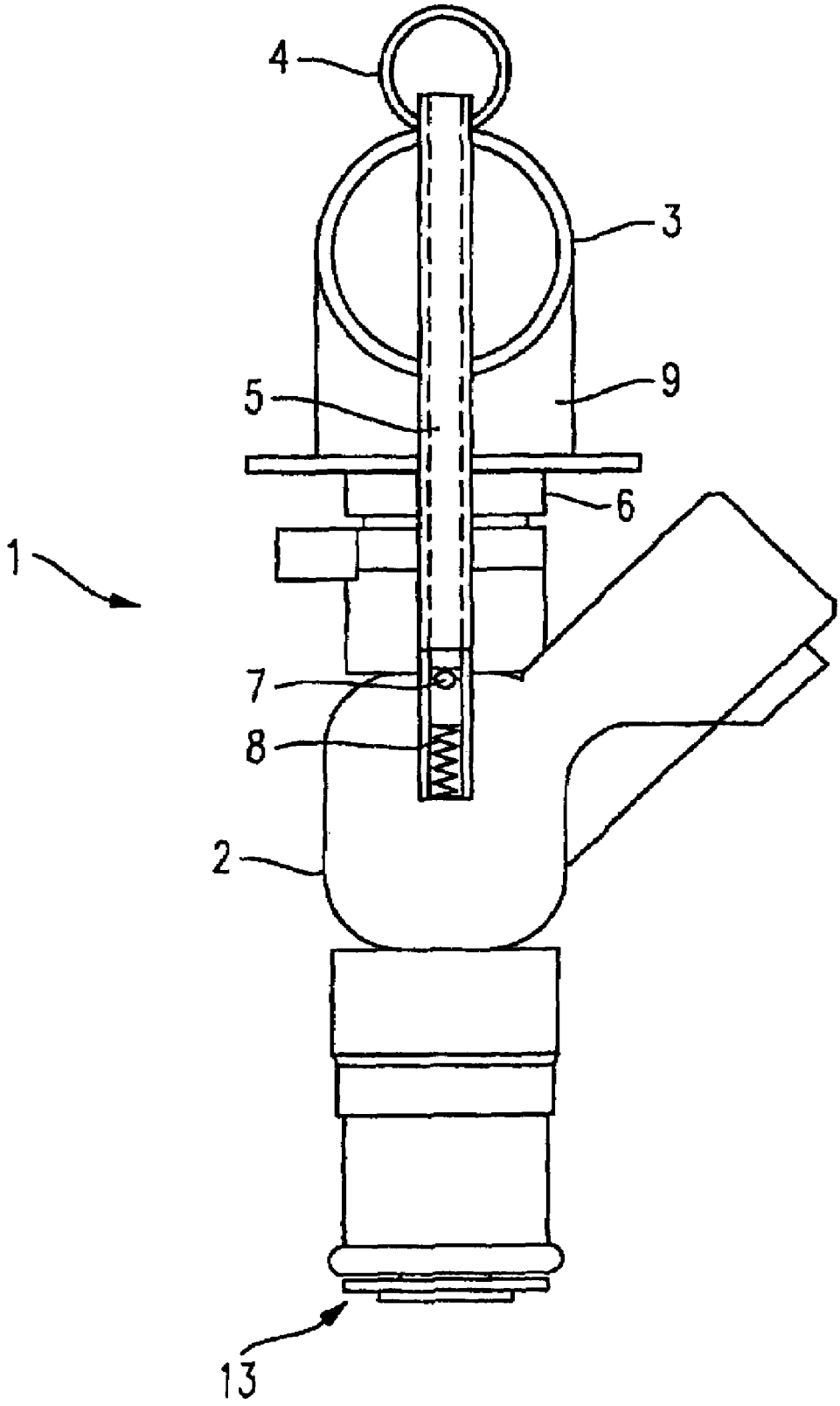
FIG. 1 shows a schematic, partial sectional view of an example embodiment of a fuel-injection system according to the present invention.

FIG. 1 shows a schematic, partial sectional view of an example embodiment of a fuel-injection system 1 configured according to the present invention. A fuel injector 2 in the form of a low-pressure fuel injector is used to inject fuel into the intake manifold of a mixture-compressing internal combustion engine having externally supplied ignition. In the following discussion, only those components are discussed that have a direct relationship to the measures according to the present invention.

Fuel injector 2 is installed in a cylinder head (not shown further) of the internal combustion engine in a series arrangement and connected to additional fuel injectors 2 (not shown) by means of a first fuel-distributor line 3. The measures according to the present invention relate to a second fuel-distributor line 4, which may be disposed parallel to first fuel-distributor line 3, for example.

Second fuel-distributor line 4 is used to supply a startup fuel whose composition with respect to its evaporation and combustion characteristics is such that the cold-start characteristics are able to be improved, and the hydrocarbon emissions in the cold phase of the internal combustion engine, as well as the nitrogen oxide emissions, are able to be reduced. As an alternative, the startup fuel may also be replaced by a purification or rinsing liquid to clean fuel injector 2 between the injection cycles. Deposits in the region of the fuel ducts and the spray-discharge orifices of fuel injector 2 are rinsed off in this manner and are prevented from causing malfunctions of fuel injector 2.

The present invention is implemented such that existing fuel injectors 2 are able to be used with the measures according to the present invention, without expensive modifications, so that the costs are able to be kept low.

To this end, second fuel-distributor line 4 has a tubular lance 5 which extends through first fuel-distributor line 3. Lance 5 discharges into fuel injector 2 via a supply-line nipple 6 of fuel injector 2.

A non-return valve 7, which may be designed as, for instance, a ball valve 7 having a spring 8, is disposed inside lance 5. Non-return valve 7 ensures that the injection with startup fuel is ended as soon as normal fuel is supplied from first fuel-distributor line 3 via a supply line 9. It is exchangeable and may be selected for a variety of pressures, for instance between 0.2 and 1 bar. A detailed description of the individual components and the method of functioning may be gathered from the description in connection with FIGS. 2A through 2C.

Lance 5 and second fuel-distributor line 4 may be soldered to first fuel-distributor line 3. The diameter of lance 5 is 4 mm, for example, so as to offer an adequate metering cross section.

Since lance 5 is fed through first fuel-distributor line 3, an additional evaporation of the startup fuel is able to be avoided.

Furthermore, lance 5 may also be designed to be heatable in order to heat up the fuel. In this manner, the cold-start characteristics may be improved by better evaporation and by a reduction in the hydrocarbons. The heating elements may be embodied in different forms such as spirals, or may be designed in the form of heating pellets.

Instead of lance 5, it is also possible to provide a pipe connected to an outer wall of fuel injector 2 through which the startup fuel is able to be conveyed to the tip of fuel injector 2. The advantage in this configuration is that the switching location between startup fuel and normal fuel is located in the region of the valve tip and only a small residual volume of the other fuel type is present there after the switchover, so that the starting emissions are improved. Here, too, it is possible to use standard production fuel injectors 2 with small modifications.

Another advantageous example embodiment combines the use of lance 5 with the switchover between startup and normal fuel by the use of two valves, so that the fuel circuits are able to be completely decoupled from one another. The return rinse may be implemented via external ducts. The fuel types are not limited here as far as the supply cross sections and the maximally possible flow rate are concerned.

Figure 2A:
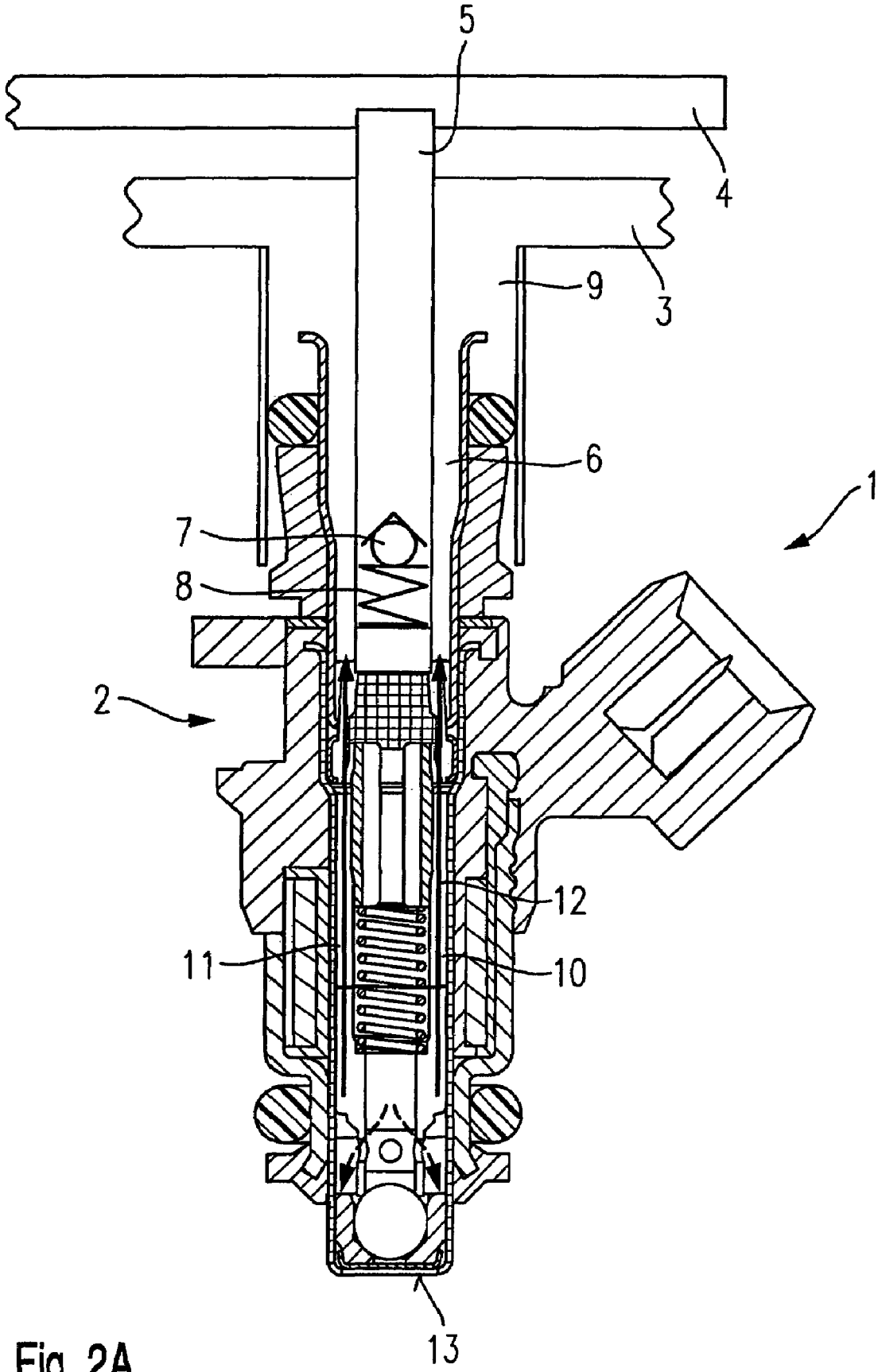
FIGS. 2A-2C show cross-sectional view of the fuel injector of the fuel-injection system shown in FIG. 1, corresponding to three consecutive method steps of fuel injection.
Figure 2B:
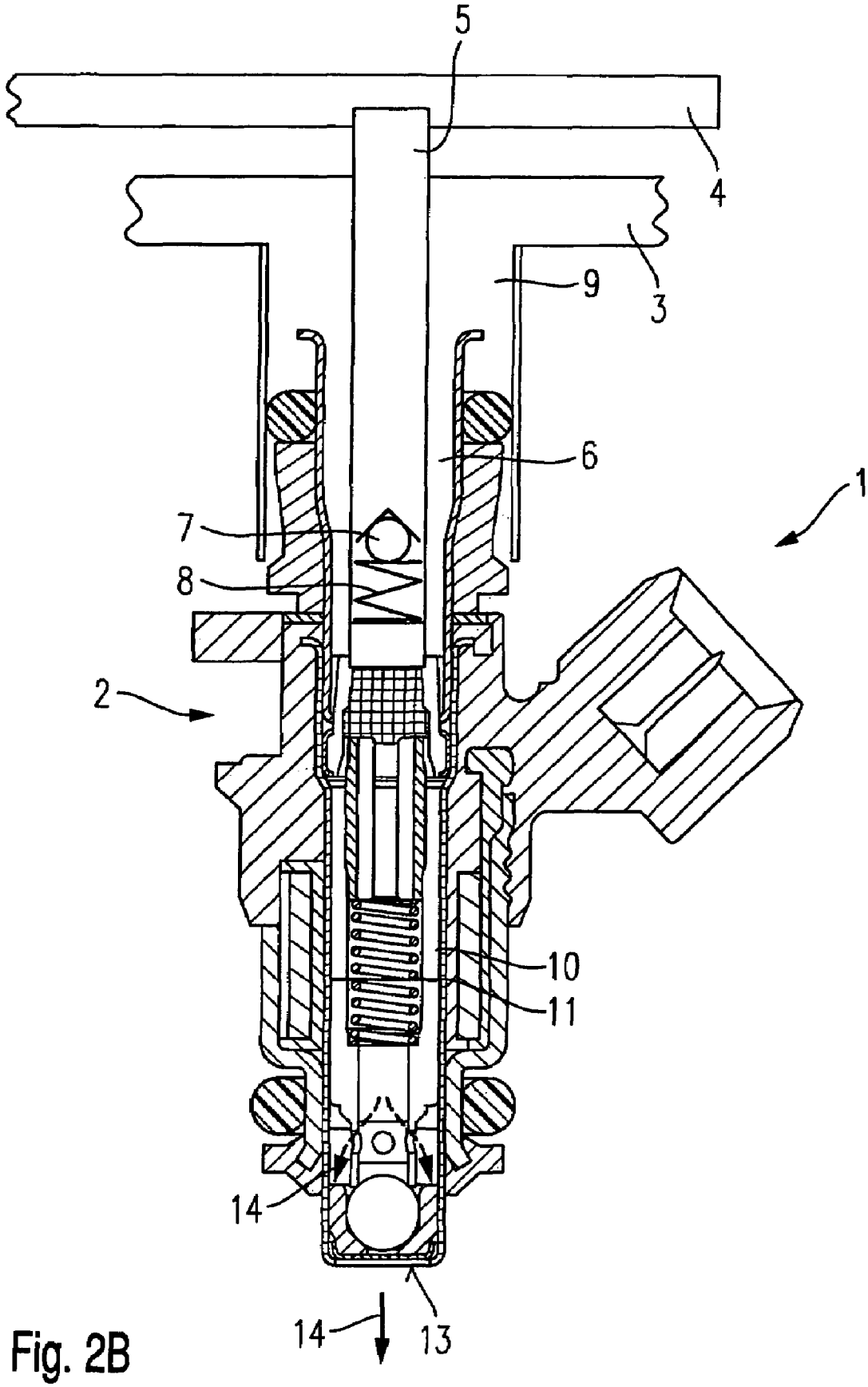
Figure 2C:
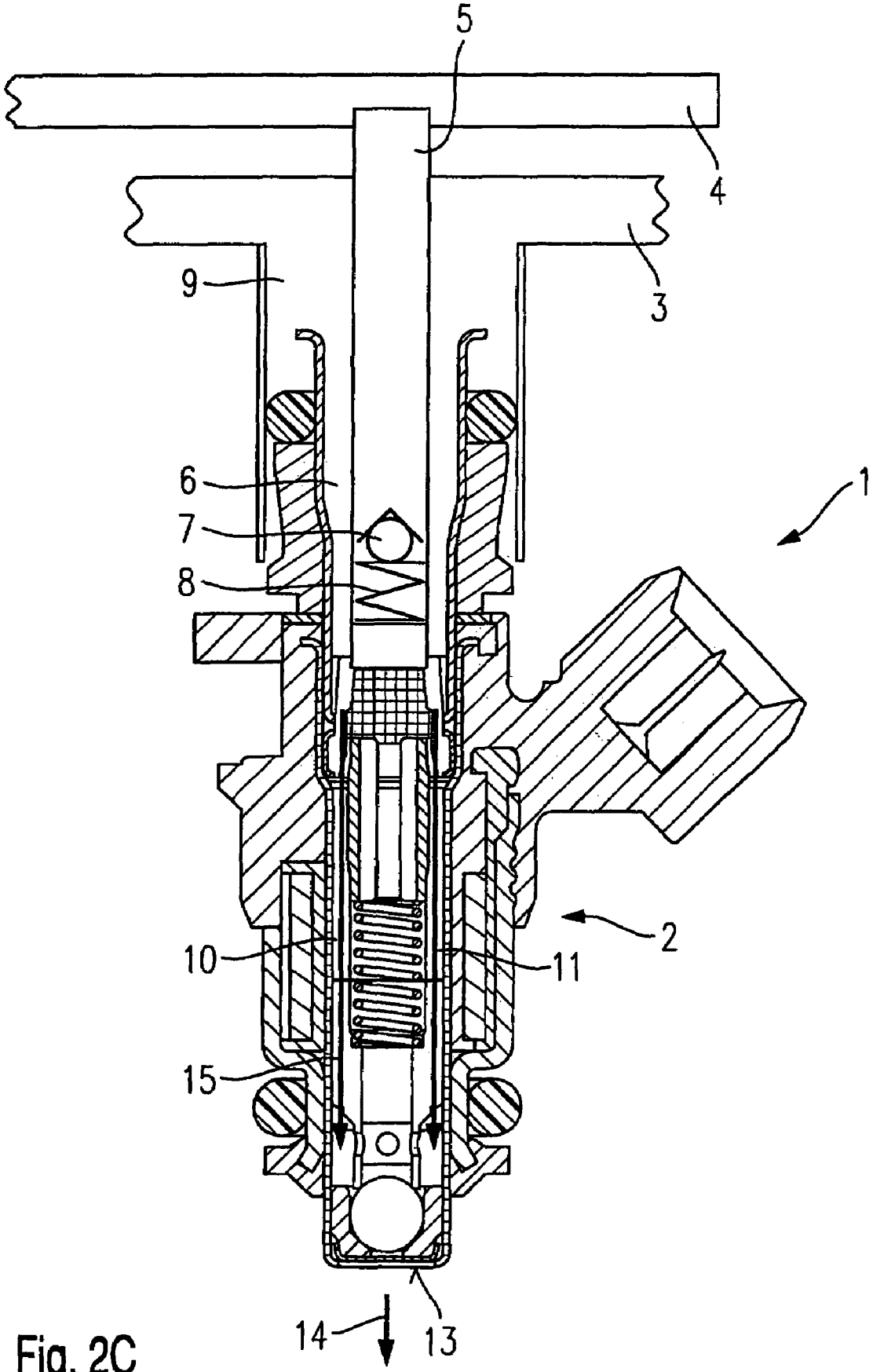

FIGS. 2A through 2C show a rinse and injection cycle for a fuel-injection system 1 configured according to the present invention, in three steps. Fuel-injection system 1 is shown in a lateral part-sectional view in the region of fuel injector 2. Reference is made only to the components of a fuel injector 2 that are essential for the present invention. In all other respects, fuel injector 2 may be configured as desired. Equivalent components have been provided with corresponding reference numerals in all figures.

FIG. 2A shows the rinsing operation as first step of the injection cycle. Here, startup fuel is conveyed from second fuel-distributor line 4 through an interior chamber 10 of fuel injector 2. Since no electrical actuation of fuel injector 2 takes place at this time, the startup fuel is not injected but flows through lateral ducts 11, as indicated by arrows 12, counter to a discharge direction, back to supply-line nipple 6 of fuel injector 2. Non-return valve 7 prevents the startup fuel from flowing back into second fuel-distributor line 4.

The goal of the rinsing operation is to dissolve and rinse off the combustion residue in the region of valve tip 13 from the previous injection cycle, so that fuel injector 2 is able to inject uniform fuel quantities into the combustion chamber of the internal combustion engine.

FIG. 2B shows the next step, i.e., the injection of startup fuel in the direction of a combustion chamber of the internal combustion engine. The startup fuel is conveyed in the same manner as in the rinsing operation shown in FIG. 2A, but it is spray-discharged toward the combustion chamber of the internal combustion engine by the simultaneous electrical actuation of fuel injector 2. This is indicated by arrows 14 in FIG. 2B. The startup fuel is adjusted such that, as explained earlier, the cold-start behavior of the internal combustion engine is influenced in a positive manner and the exhaust emissions are able to be reduced.

Finally, FIG. 2C shows the third step of the injection cycle during which normal fuel is conveyed to valve tip 13 from first fuel-distributor line 3 via intake 9 and lateral ducts 10, the fuel being spray-discharged toward the combustion chamber of the internal combustion engine. The normal fuel flows through fuel injector 2 along the path indicated by arrows 15 and 14. Normal fuel will be spray-discharged as soon as the internal combustion engine has reached its operating temperature, which may be measured by a suitable sensor. The normal fuel may be a fuel having greater energy density, for instance, which in this cases requires no addition of purifying agents.

The present invention is not limited to the example embodiment shown, and is also suitable, for instance, for fuel injection systems of mixture-compressing, internal combustion engines having self-ignition.

What is claimed is:

1. A fuel-injection system for injection of fuel into an internal combustion engine, comprising:

at least one fuel injector;

a first fuel-distributor line connected to the at least one fuel injector; and a second fuel-distributor line connected to the at least one fuel injector by a lance;

wherein the lance penetrates the first fuel-distributor line.

2. The fuel-injection system as recited in claim 1, wherein the second fuel-distributor line is disposed in parallel to the first fuel-distributor line.

3. The fuel-injection system as recited in claim 2, wherein the second fuel-distributor line is connected to the first fuel-distributor line by soldering.

4. The fuel-injection system as recited in claim 1, wherein the lance is connected to the second fuel-distributor line by soldering.

5. The fuel-injection system as recited in claim 1, wherein the lance extends into a supply-line nipple of the at least one fuel injector.

6. The fuel-injection system as recited in claim 5, wherein the lance has a diameter of approximately 4 mm.

7. The fuel-injection system as recited in claim 5, wherein the at least one fuel injector is connected to the first fuel-distributor line via an intake.

8. A fuel-injection system for injection of fuel into an internal combustion engine, comprising:

at least one fuel injector;

a first fuel-distributor line connected to the at least one fuel injector; and a second fuel-distributor line connected to the at least one fuel injector by a lance;

wherein the lance extends into a supply-line nipple of the at least one fuel injector; and wherein a non-return valve is provided inside the lance.

9. The fuel-injection system as recited in claim 8, wherein the non-return valve includes a ball valve having a spring.

10. A method for injecting fuel into a combustion chamber of an internal combustion engine with the aid of a fuel-injection system having at least one fuel injector, a first fuel-distributor line connected to the at least one fuel injector, and a second fuel-distributor line connected to the at least one fuel injector by a lance, the method comprising the steps:

a) conveying start-up fuel into the at least one fuel injector via the second fuel-distributor line and the lance, whereby rinsing of the fuel injector is achieved;

b) conveying start-up fuel into the at least one fuel injector via the second fuel-distributor line and the lance, and substantially simultaneously actuating the at least one fuel injector to inject the start-up fuel into the combustion chamber of the internal combustion engine;

c) repeating the steps a) and b) until a desired operating temperature of the internal combustion engine has been reached; and d) conveying fuel for normal engine operation into the at least one fuel injector via the first fuel-distributor line and an intake, and substantially simultaneously actuating the at least one fuel injector to inject the fuel for normal engine operation into the combustion chamber of the internal combustion engine.

* * * * *